United States Patent [19]

Handler

[11] 4,266,165

[45] May 5, 1981

[54] HIGH INTENSITY DISCHARGE LAMP STARTING CIRCUIT

[75] Inventor: Howard Handler, Westminster, Calif.

[73] Assignee: Datapower, Inc., Santa Ana, Calif.

[21] Appl. No.: 973,613

[22] Filed: Dec. 27, 1978

[51] Int. Cl.[3] ..... H05B 41/14; H05B 41/36

[52] U.S. Cl. ..... 315/224; 315/208; 315/283; 315/287; 315/289; 315/307; 315/DIG. 7

[58] Field of Search ..... 315/208, 209 R, 224, 315/283, 287, 289, 290, 291, 307, 311, DIG. 5, DIG. 7

[56] References Cited

U.S. PATENT DOCUMENTS

| | | | |
|---|---|---|---|
| 3,569,775 | 3/1971 | Halsted et al. | 315/287 X |
| 3,906,302 | 9/1975 | Wijsboom | 315/289 X |
| 3,969,652 | 7/1976 | Herzog | 315/290 X |
| 3,999,100 | 12/1976 | Dendy et al. | 315/287 X |
| 4,162,429 | 7/1979 | Elms et al. | 315/311 X |

*Primary Examiner*—Eugene R. La Roche
*Attorney, Agent, or Firm*—Knobbe, Martens, Olson, Hubbard & Bear

[57] ABSTRACT

A gas discharge lamp is connected across an inductor and in series with a solid state switching device and a resistor, and this combination is connected across a rectified AC voltage source. This switching device is controlled by a monostabile multivibrator, the input of which is connected to the output of a comparator amplifier sensing the difference between the voltage drop across the above-mentioned resistor and a voltage which may be selected to vary light intensity. The secondary winding of a step-up transformer connected to a capacitive discharge device is placed in series with the lamp. Control circuitry is provided to apply a large ignition voltage to the lamp while preventing damage to the switching device by simultaneously holding it in its conductive state. A diode rectifier provides an alternate current path across the secondary winding to prevent the inductance of the secondary winding from affecting normal lamp operation. Means are provided to cancel the contribution of lamp current to the voltage drop across the resistor sensed by the comparator, thereby rendering power consumed by the circuit independent of the effective resistance of the lamp.

18 Claims, 10 Drawing Figures

Fig. 1 (PRIOR ART)
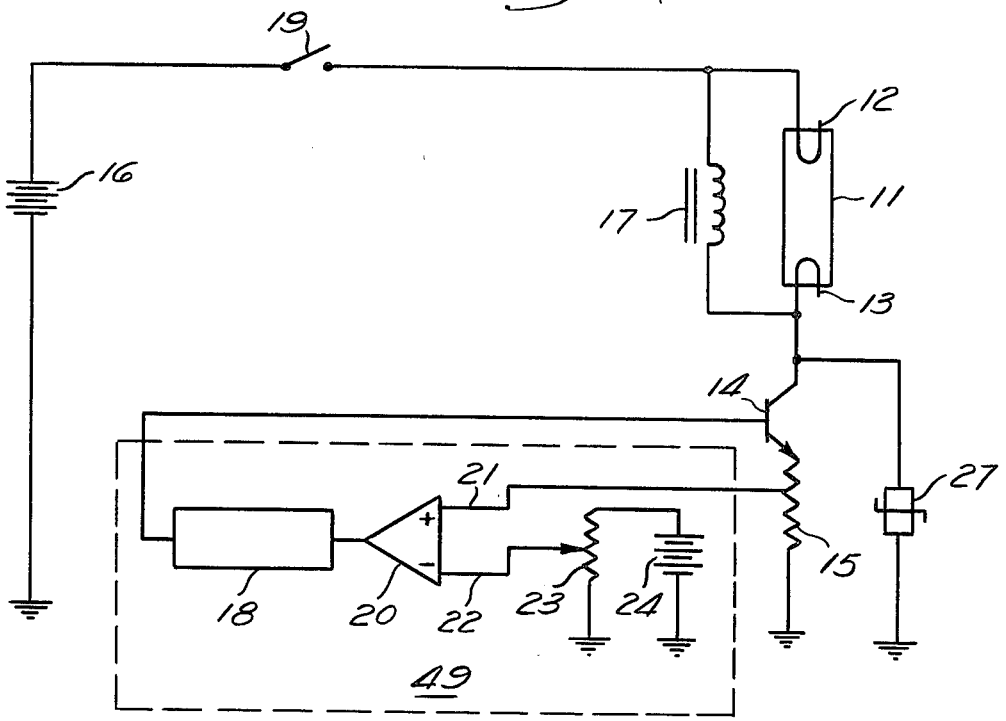
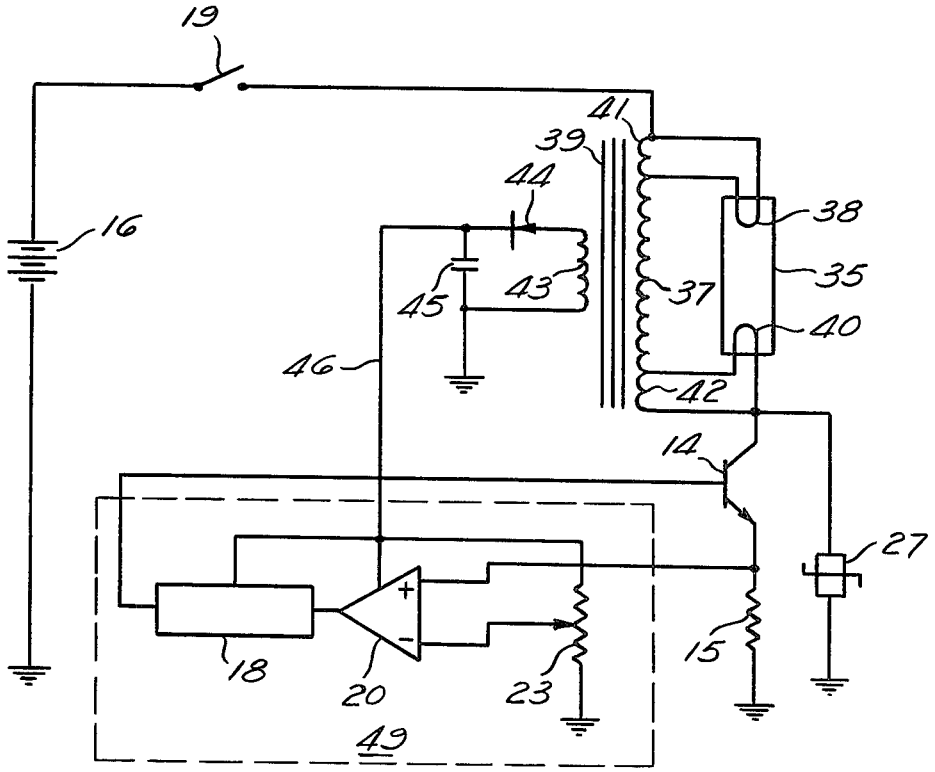
Fig. 3 (PRIOR ART)

19
16
17
11
50
52
51
53
49
14
27
54
15

19
16
17
11
53
55
52
51
50
49
14
27
15
56
56b
56a 16
11
17
63
61
62
64
65
60
23
20
18
14
20a
15
66
68
67

HIGH INTENSITY DISCHARGE LAMP STARTING CIRCUIT

BACKGROUND OF THE INVENTION

1. Field of the Invention

This invention relates to apparatus for operating a gas discharge lamp, such as a fluorescent light, a mercury vapor lamp, a sodium lamp, or a metal halide lamp.

2. Related Applications

This application discloses subject matter which is related to United States Patent Applications Ser. No. 865,209, Filed Dec. 28, 1977; Ser. No. 940,435, Filed Sept. 7, 1978; and Ser. No. 968,372, filed Dec. 11, 1978; all by Francis Henry Gerhard and Gerald Allen Felper; all for "VARIABLE INTENSITY CONTROL APPARATUS FOR A GAS DISCHARGE LAMP".

3. Description of the Prior Art

Control circuits for gas discharge lamps are known which obviate the need for the usual heavy and expensive series ballast devices, corresponding to the inductor in this device. In such circuits, switching elements are provided to periodically reverse the direction of current through the lamp to reduce the deterioration or errosion of electrodes, and to ensure a high enough frequency of switching to reduce the requirement for the size of the ballast. Such circuits generally require two switching elements for each direction of the current.

Attempts have been made to fabricate the same type of circuit using only a single switching element to cause current reversal in the lamp. For example, the U.S. patent to D. B. Wijsboom, U.S. Pat. No. 3,906,302, is directed to such an arrangement and incorporates an inductor in parallel with the lamp, which lamp is in series with a switching device. Such a switching device is generally operated at relatively high frequencies, such as 20 KHz.

One problem has been that the fly back voltage during current reversal required to ignite the lamp when the circuit is first activated must be large enough to generate a sufficiently strong voltage gradient in the lamp to ionize the gas. This causes a large voltage to appear across the switching device which can damage the device during ignition, thereby limiting the reliability of the control circuit.

One solution to this problem is to use a step-up voltage transformer connected to a capacitive discharge device which provides sufficient voltage for a short period of time to ionize the lamp without requiring the flyback voltage of the control circuit to be large. However, this creates further problems because a step-up transformer must be connected in series with the lamp, and, after the lamp circuit has assumed normal operation, the large winding ratio of the transformer will cause significant current to flow in the primary winding with consequent power losses. This additional problem may be alleviated by opening up the primary winding after the lamp has ignited. However, this creates further problems because the secondary winding of the step-up transformer now acts as a second inductor in the lamp control circuit, impeding current flow through the lamp during flyback and further increasing the flyback voltage across the switching device, which may damage the switching device.

Another problem in the prior art has been that when a high pressure sodium lamp is used with the lamp control circuit, its resistance is well known to increase during the life of the lamp, which increases power consumption of the circuit, and decreases the efficiency of the lamp circuit.

SUMMARY OF THE INVENTION

A gas discharge lamp is connected across an inductive device. One end of the inductive device is connected to a rectified power source and the other end is connected to the collector of a transistor switch. The emitter of the transistor is connected to one end of a resistor, and the other end of the resistor is connected to the power supply return. The base of the transistor is connected to the output of a monostabile or one-shot multivibrator. The input to the one-shot multivibrator is connected to the output of a comparator amplifier. The multivibrator operates in such a way that when the input to the multivibrator is high, the multivibrator is triggered and its output goes low for a predetermined amount of time, after which its output returns to the high state. The two inputs to the comparator amplifier are connected in such a way that one input is connected to the emitter of the transistor and the other input is connected to a voltage source which may be varied or controlled. The circuit components and the time delay of the multivibrator are chosen in such a way as to provide a relatively high rate of switching on the base of the transistor, approximately 20 to 40 KHz.

This invention includes the novel feature of a step-up pulse transformer having its secondary winding connected in series with the lamp and its primary winding driven by a capacitive discharge circuit, the combination providing very high ignition voltage to the lamp, but including additional means preventing the inductance of the secondary winding from affecting the operation of the lamp circuit after the lamp is ignited and the lamp circuit is operating in its normal mode. This feature is provided by a rectifier diode connected across the secondary winding of the step-up transformer having its polarity oriented so that it provides an alternate current path when the switching device causes the voltage in the lamp control circuit to fly back. This invention further includes means for delaying the operation of the multivibrator in the lamp control circuit after power is first applied in order to permit the capacitive discharge device to become fully charged.

This invention also includes a novel feature which makes the power consumed by the lamp control circuit independent of the effective lamp resistance. This is accomplished by providing another transformer having its primary winding connected in series with the lamp and its secondary winding wound to an opposite polarity to provide a voltage proportional to the lamp current but of opposite polarity. This opposite polarity voltage is applied to one input of the comparator amplifier. As a result, the comparator amplifier senses only the voltage drop caused by the current through the primary winding of the inductive device. Thus, the lamp current does not affect the operation of the comparator amplifier, and thus the comparator amplifier is permitted to control current through the lamp circuit independently of the actual current to the lamp. This renders the power consumption of the circuit independent of effective lamp resistance.

BRIEF DESCRIPTION OF THE DRAWINGS

The invention will be described in detail with reference to the accompanying drawings in which:

FIG. 1 illustrates an embodiment of a control circuit for a gas discharge lamp shown in simplified form for facilitating an understanding of the overall function of the control apparatus;

FIG. 2 shows four waveform plots labeled 2A, 2B, 2C, and 2D which are characteristic of the control circuit illustrated in FIG. 1.

FIG. 3 illustrates a modified form of the control circuit of FIG. 1 in which the choke or inductor windings are used as the primary windings of a step-down transformer which supplies power for the one-shot multivibrator and the comparator amplifier as well as the reference voltage to the input of the comparator amplifier. FIG. 3 also illustrates the use of the primary coil as an auto transformer to supply current to the electrodes of the gas discharge lamp as a source of preheating current prior to ignition of the lamp;

PRIOR ART CONTROL CIRCUITS

Figure 2A:
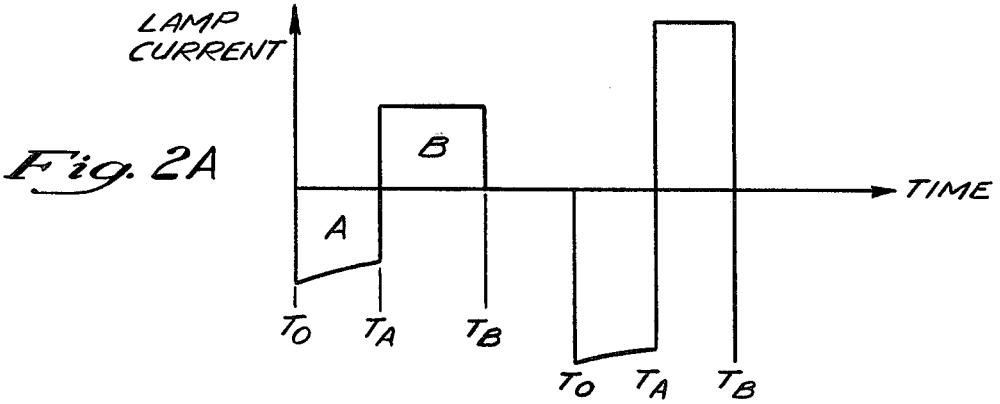
FIG. 2A is a plot of the current through the gas discharge lamp as a function of time.

The prior art control circuits illustrated in FIGS. 1 and 3 form a basis for this invention. Therefore, a description of these prior arts circuits is included herein for the sake of clarity.

Referring to the prior art circuit illustrated in FIG. 1, a gas discharge lamp 11, typically a low-pressure mercury vapor fluorescent lamp, having two electrodes 12 and 13, has its electrode 13 connected to an electronic switch shown as an NPN transistor 14, the collector of which is connected to electrode 13, and the emitter connected to a resistor 15. The other end of the resistor 15 is connected to ground. The other electrode of the gas discharge tube 12 is connected to a DC power supply. This supply will normally be a rectified AC source but is shown for simplicity in this figure as a battery 16 whose positive terminal is connected through on-off switch 19 to electrode 12 and whose negative terminal is connected to ground. A choke or inductor 17 is connected in parallel with the electrodes of the gas discharge lamp 12 and 13.

The base of the NPN transistor switch 14 is connected to the output of a one-shot multivibrator 18. The monostabile multivibrator operates in such a way that when the input to the multivibrator is low its output is high, and when its input is high, the monostabile multivibrator is triggered such that its output goes into the low state for a predetermined finite length of time, after which the output of the multivibrator returns to the high state. The input of the multivibrator is connected to the output of a comparator amplifier 20. The positive input of the comparator amplifier is connected through a conductor 21 to the emitter of the NPN transistor 14, and the negative input of the comparator amplifier is connected through a conductor 22 to a potentiometer 23. Potentiometer 23 is connected to the positive end of a DC power source 24, and the negative end of the DC power source 24 is connected to ground.

The operation of the circuit of FIG. 1 is as follows. When the switch 19 is first closed, the current passes through the switch 19 and through the inductor 17. No current passes through the gas discharge lamp 11 because, until it is ignited by high voltage, the lamp remains nonconductive. The current through the inductor passes through the NPN transistor switch 14 and through the resistor 15 to ground. The current through the inductor 17 rises as a function of time until it reaches a level at which the voltage drop across the resistor 15 exceeds the voltage on the conductor 22. The voltage on the conductor 22 is determined by the potentiometer 23. When the voltage drop across the resistor 15 exceeds the voltage on the conductor 22, the comparator amplifier 20 senses a positive difference between its inputs and the output of the comparator amplifier 20 changes from the low to the high state. In response to the high output of the comparator amplifier 20, the one-shot multivibrator 18 is triggered and provides a low output for a short predetermined length of time. Thus, the transistor switch 14 will be turned off for the short period of time during which the base of the transistor receives a low level signal from the multivibrator 18. The magnetic field in the choke 17 then collapses, resulting in a flyback voltage potential across the electrodes 12 and 13 of the gas discharge lamp 11. This potential is sufficient to ignite the lamp and the lamp begins to conduct current. The flyback voltage is also applied to the collector of the transistor 14.

After the above-mentioned short predetermined length of time, the one-shot multivibrator output returns to its normally high level state, thereby turning the transistor switch 14 back on. At this instance in time, current begins to flow from the source 16 through the electrodes 12 and 13 of the gas discharge lamp 11 in the opposite direction to the current supplied before by the choke 17. The magnetic field in the choke 17 also begins to build up again as does the current through the choke 17. This results in a rise in the collector current of the transistor 14 and an equal rise in current through the resistor 15. This rise in current will cause the voltage drop across resistor 15 to rise until the voltage on the conductor 21 again exceeds the voltage on conductor 22. Again, the comparator amplifier 20 will give a high output when this condition is reached, causing the output of the multivibrator 18 to go into the low state for the finite period of time thereby turning off the collector current of the transistor 14. The magnetic field in the choke 17 will collapse at this time, thereby causing a current to flow between the electrodes 12 and 13 of the gas discharge lamp 11 in a direction opposite to the direction traveled by the current when the transistor 14 was on. This condition will continue until the multivibrator output returns automatically to the high state.

As may be seen from this description, this process will continue to repeat itself as the transistor 14 continuously is switched on and off until steady state conditions are achieved. One or more cycles of operation may be required to ionize the lamp and cause it to ignite.

A varistor or high voltage zener diode 27 is connected between the collector of the NPN transistor and ground, and serves to protect the transistor 14 from destructive breakdown in the event of lamp failure causing an open circuit between its terminals, or inadvertent unplugging of the lamp when the power switch 19 is closed. When the lamp itself is defective and causes an open circuit or when the lamp is removed, the voltage rise at the collector of transistor 14 produced by collapse of the magnetic field in the inductor 17 will be limited to the breakdown voltage of the varistor, a value selected to be within the safe limits of the collector-base junction of the transistor switch 14.

A significant feature of this prior art control circuit is that the varistor 27 serves the additional function of preventing ignition of the lamp until the lamp electrodes have been warmed up over a time period which is long compared to the operating period of the control circuit. Thus, the prior art control circuit, without the varistor, would typically supply on the order of 1,000 volts across the lamp in the flyback mode. Such high voltage applied to the lamp filaments when they are cold would be extremely deleterious since the electrodes would undergo a very high rate of change of temperature. The varistor is selected such that it breaks down for voltages exceeding 500 to 600 volts. At these lower voltages, the lamp 11 will not ignite until after the cathodes have been heated. Typically, a time delay of $\frac{3}{4}$ second to one second is the amount of time needed to heat up the cathodes sufficiently for the lamp to ignite when suplied with 500 to 600 volts.

FIGS. 2A, 2B, 2C, and 2D are plots of the steady state response characteristics of the prior art circuit of FIG. 1 for two different levels of input power to the gas discharge lamp.

FIG. 2A is a plot of a single cycle of current through the gas discharge lamp as a function of time. The current is plotted on the vertical axis and the time is plotted on the horizontal axis. It will be understood that the current alternates through the lamp in a repetitive cycle. In the region of FIG. 2A, denoted "A", the transistor switch 14 is in the off state and the collapsing field in the inductor 17 is forcing a current through the gas discharge lamp. The region A covers a period of time between time $T_0$ and time $T_A$. This time period is equal to the unstable period of multivibrator 18. In the region in FIG. 2A denoted "B", the transistor switch 14 is on. The region B lies between the time $T_A$ and the time $T_B$, after which the cycle repeats itself.

In FIG. 2A, the magnitude of the lamp current in region A is shown to be roughly equal to the magnitude of the current in region B. Since, for reasons described above, there is no net DC current through the lamp, the respective areas under the curves in regions A and B are equal. Thus, in the circuit operating mode illustrated in FIG. 2A, the duration of the time periods A and B are roughly equal. The operational mode shown in FIG. 3A having approximately equal current flows in regions A and B is advantageous since it maximizes the efficiency of the lamp and also minimizes the current handling requirements for the switch transistor 14. This operating mode is achieved for a fairly narrow range of DC voltage output of the power source 16 for a given lamp.

Figure 2B:
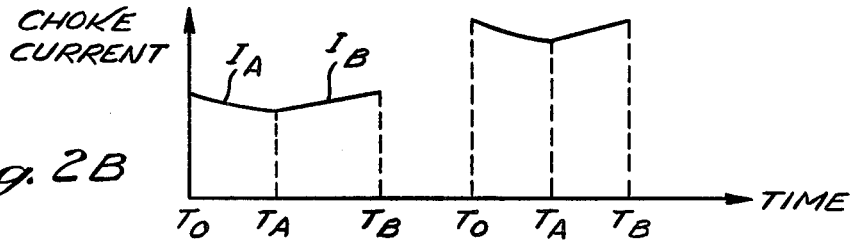
FIG. 2B is a plot of the current through the choke or inductor as a function of time.

FIG. 2B is a plot of the current through the choke or inductor 17 as a function of time. The current through the choke is plotted on the vertical axis, while time is plotted on the horizontal axis. In the region of FIG. 2B denoted "A", at time $T_0$, the transistor has been turned off and the current through the choke in the region of FIG. 2B denoted "B" increases until time $T_B$, at which time the transistor is turned back off, and the cycle repeats itself. The behavior of the circuit thus alternates between the behavior plotted in region A and the behavior plotted in region B.

Figure 2C:
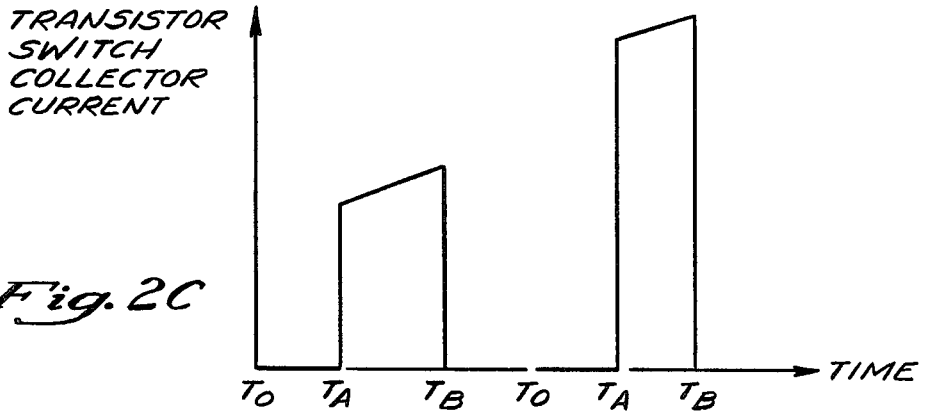
FIG. 2C is a plot of the collector current of the transistor as a function of time.

FIG. 2C is the plot of the collector current of the transistor plotted as a function of time. The collector current amplitude is plotted on the vertical axis and time is plotted on the horizontal axis. In the region denoted A of FIG. 2C, the transistor is off and therefore the collector current remains zero, from time $T_0$ to the end of region A at time $T_A$. In the region denoted B in FIG. 2C, at time $T_A$, the transistor is turned on and remains on until time $T_B$, which defines the end of region B. During this time, the collector current continually increases. At time $T_B$ the transistor is again turned off and the process repeats itself. Thus, the collector current is periodic in time. The current level indicated by the plot is equal to the voltage on the conductor 22 of FIG. 1 divided by the resistance of the resistor 15 in FIG. 1.

Figure 2D:
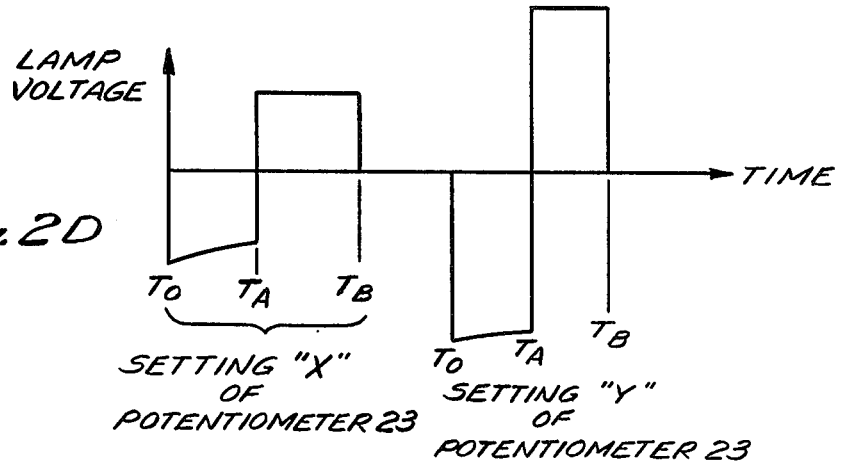
FIG. 2D is a plot of the voltage across the gas discharge lamp as a function of time. In all of these plots, time is plotted on the horizontal axis and the voltage or current is plotted on the vertical axis.

FIG. 2D is a plot of the voltage across the gas discharge lamp as a function of time. It is identical in shape to the lamp current shown in FIG. 2A at the operating frequency of the circuit, i.e., the frequency at which the transistor switch 14 is switched on and off. This frequency is chosen so that its period is short compared to the ionization time of the lamp. A representative operating range is from between 20 to 40 kHz. At this high frequency, the lamp appears electrically to be a resistor. Since the current through a resistor is linearly proportioned to the voltage across it, the lamp voltage and current wave forms are identical in shape.

The prior art control circuit of FIG. 1 has the significant advantage that the weight of the choke, shown in FIG. 1 as 17, may be considerably reduced below the weight of the typical chokes found in the usual fluorescent lamp circuits using 60-Hz AC sources. By way of specific example, a choke suitable for use at 20 kHz will weigh on the order of 4 or 5 ounces whereas the corresponding choke for use at 60 Hz will weigh 4 or 5 pounds.

A feature of the prior art control circuit of FIG. 1 is that a selectively variable control over lamp intensity may be provided by the potentiometer 23. The power input to the lamp (and the resultant lamp intensity) are approximately proportional to the average magnitude of the lamp current, which is plotted in FIG. 2A. This plot shows the current reversal during periods when the transistor is turned off, which occurs, for example, at time $T_B$.

Assume that at a particular setting "X" of the potentiometer 23 in FIG. 1, the voltage on conductor 22 in FIG. 1 is lower than the voltage on the conductor at another setting "Y" of the potentiometer 23. The corresponding changes in the waveforms in FIGS. 2A, 2B, 2C, and 2D between the two settings of the variable resistor for effecting different levels of the lamp intensity are illustrated in these figures. In each figure, the waveform on the left respresents setting X and the waveform on the right in each figure represents setting Y.

The manner in which this control is achieved with potentiometer 23 is as follows.

The peak lamp current always occurs whenever the transistor is turned off, corresponding to times $T_0$ and $T_B$. This occurs whenever the sum of the choke current and lamp current passing through the resistor, denoted 15 in FIG. 1, causes a voltage drop across this resistor equal to the voltage on the conductor, denoted 22 in FIG. 1. As stated above, this occurrence causes the comparator amplifier, 20 in FIG. 1, to give a positive output to the multivibrator, which in turn causes the multivibrator to turn the transistor off.

The current passing through the resistor, 15 in FIG. 1, is the collector current of the transistor. This current is plotted in FIG. 2C, as the sum of the lamp current and choke current in region B.

The peak collector current level is equal to the voltage on the conductor 22 in FIG. 1 divided by the resistance of the resistor, 15 in FIG. 1. When the voltage on the conductor 22 is increased or decreased, the collector current peak level will increase or decrease, respectively. Because the decay time of the current between time $T_0$ and time $T_A$ is always the same, the minimum value of the collector current will also increase or decrease, respectively. Thus, the entire waveform of the collector current will be shifted either up or down, respectively, of which two exemplary waveforms are plotted for the two different potentiometer settings X and Y. The waveforms of the choke current and the lamp current will also be shifted up or down respectively, as shown. This effect is the result of the fact that the collector current through the transistor is the sum of the choke current and lamp current, and the fact that the lamp current is proportional to the choke current.

Thus, it may be seen that the lamp intensity, which is proportional to lamp current, is proportional to the voltage on the conductor 22. By changing the resistance of the potentiometer 23 in FIG. 1, the current supplied to the lamp 11 will change.

Another feature of the prior art control circuit of FIg. 1 is that the useful life of the gas discharge lamp is increased since the net DC component of current through the lamp during continued operaton is approximately zero. This is achieved by virtue of the parallel inductance which has the property of maintaining a zero DC voltage drop across its terminals. Since this zero DC voltage is also maintained across the lamp, the DC current through the lamp will also be zero.

FIG. 3 illustrates a modified embodiment of the prior art control circuit of FIG. 1 in which a gas discharge lamp 35, typically a low pressure mercury vapor fluorescent lamp of approximately 22 watts, is provided. The electrodes 38 and 40 are of the heated type. Power is derived from a DC voltagd source 16.

An inductor 37 is connected in series with the transistor 14 and resistor 15 across the power supply 16. The electrodes 38 and 40 of lamp 35 are tapped into sections 41 and 42 of the winding of inductor 37 to preheat such electrodes prior to ignition of the lamp.

The inductor 37 also acts as the primary winding of a transformer and has an iron core 39 and a step-down secondary winding 43 associated therewith. The winding 43 is connected in circuit with a diode 44 across a capacitor 45. The diode 44 is also connected through line 46 to the power input terminals of the comparator amplifier 20 and multivibrator 18. It is also used to supply the reference voltage to the potentiometer 23.

The sections 41 and 42 of the winding of inductor 37 enable the electrodes 38 and 40 to become heated before the lamp is ignited. This arrangement maximizes electrode lift and prevents damage to the electrodes 38 and 40 due to the otherwise excessive rise of temperature at the start of a lamp operation.

The polarity of the winding 43 is preferably such that the capacitor 45 is charged only when the transistor 14 is conducting. This arrangement insures that the particular voltage on capacitor 45 is independent of the variable flyback voltage developed by the inductor 37 when the transistor 14 is cut off.

These prior art control circuits are particularly suited for use with low intensity, low pressure mercury vapor fluorescent lamps. However, when used to control various other types of gas discharge lamps such as high pressure mercury vapor, high or low pressure sodium, and metal Halide lamps, significant problems may arise.

One problem with the lamp control circuit of FIGS. 1 and 3 is that, if the lamp voltage illustrated in FIG. 2D during the flyback mode of the circuit from $T_0$ to $T_A$ is of insufficient magnitude to ignite lamp 11 when the switch 19 is first closed, then other means must be provided to furnish a sufficiently high voltage to ignite the lamp when the circuit is first activated. A typical high intensity discharge lamp such as a 400-watt high pressure sodium lamp, requires approximately 2500 volts across the lamp in order to ignite the lamp. One solution may be found by looking to prior art fluorescent lamp ballasts which operate at 60-Hertz and which must of necessity use very large and heavy inductors. In these prior art ballast circuits, the common technique for igniting the fluorescent lamp is to connect the secondary winding of a step-up transformer in series with the lamp, and connect the primary winding to a capacitive discharge device. Such a scheme presents insignificant problems in these prior art heavy ballast circuits because the additional inductance of the secondary winding is small compared to the inductance already present in the ballast. Furthermore, these prior art 60-Hertz ballast circuits do not fly back, as does the 20-KHz lamp circuit of this invention. As will be seen in a later portion of this description, the flyback cycle of the lamp control circuit of this invention creates special problems when the step-up transformer is introduced.

Figure 4:
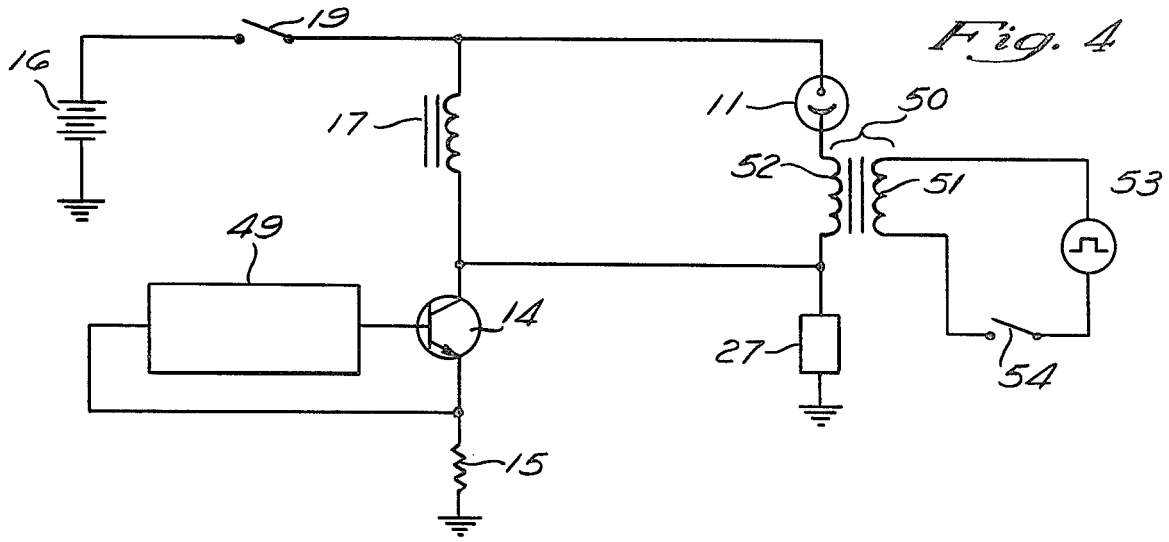
FIG. 4 is a schematic diagram of a lamp control circuit similar to that of FIGS. 1 and 3, but including a step-up transformer having its secondary winding connected in series with the lamp and its primary winding connected to a capacitive discharge device, in which the inductance of the secondary winding interferes with the normal operation of the lamp control circuit.

FIG. 4 illustrates a circuit which provides the ignition voltage of 2500 volts in a lamp control circuit similar to the control circuit as illustrated in FIG. 1 but using a high voltage ignition circuit similar to that used with prior art lamp ballast circuits. The high voltage ignition circuit includes a step-up transformer 50 having a primary winding 51 and a secondary winding 52. The secondary winding 52 is connected in series with the gas discharge lamp 11 while the primary winding 51 is connected to a pulse voltage source 53, which may, for example, be a capacitive discharge device. Control circuit 49 of FIG. 4 includes the control components of FIG. 1 includng the multivibrator 18, the comparator amplifier 20, the potentiometer 23, and the reference voltage source 24.

The pulse transformer 50 has a step-up ratio which is sufficient to provide 2500 volts to the lamp 11. Thus, when it is desired to ignite the lamp 11, the capacitive discharge device 53 provides a high voltage pulse to the primary windings 51, which is stepped up by the pulse transformer 50 to approximately 2500 volts across the secondary winding 52. This 2500 volts appears across the lamp 11, and causes the gas inside the lamp 11 to begin to ionize. If the first voltage pulse from the capacitive discharge device 53 is insufficient to completely ignite the lamp, the process will be repeated until ionization in the lamp is complete and the lamp 11 begins to conduct. At this point, the remainder of the control circuit may begin to function as described above in connection with FIGS. 1, 2, and 3.

Unfortunately, the control circuit of FIG. 4 has the disadvantage that, after the lamp 11 has ignited, current through the lamp 11 will cause a current to be induced through the primary winding 51 having a large magnitude corresponding to the large step-up ratio of the transformer 50. As a result, a significant power loss will occur through the transformer 50. This will decrease the efficiency of the control circuit of FIG. 4 significantly. A solution to this problem is to provide a switch 54 which may be opened to prevent current from flowing through the primary winding 51. However, after the switch 54 has been opened, the secondary winding 52 now acts as a large inductor in series with the lamp in addition to the inductor 17.

At this point, the undesirability of applying the starting circuit used in prior art 60-Hertz lamp ballast circuits to the high frequency switching circuit of FIG. 1 is apparent. One significant feature of the high frequency switching circuit of FIG. 1 is that the circuit flies back at a frequency of 20-KiloHertz, and as a result the inductance of the inductor 17 may be very small in comparison with the large inductors typically used in prior art 60-Hertz lamp ballast circuits. Because the lamp ballast circuits of the prior art typically have large inductors, introduction of the secondary winding of the step-up transformer of the ignition circuit did not represent a significant increase in the inductance of the circuit, and therefore, introduction of the high voltage ignition circuit into the prior art ballast circuits did not change the operation of these circuits significantly. In contrast, the addition of the secondary winding 52 to the 20-KiloHertz lamp control circuit of FIG. 4 represents a significant increase in the inductance in the circuit because the inductor 17 is relatively small. Furthermore, unlike the 60-Hertz ballast circuits of the prior art, the 20-KiloHertz control circuit of FIG. 1 flies back each 20-KiloHertz cycle. This creates special problems in introducing the step-up transformer 50 in series with the lamp 11 which are peculiar to the 20-KiloHertz control circuit of FIG. 4, and which were not encountered with the prior art 60-Hertz ballast circuits. During the flyback cycle of the 20-KiloHertz control circuit of FIG. 4, when the transistor 14 is turned off, the flyback voltage of the inductor 17 must cause a reversal of the direction of the current in the lamp 11. The magnetic field in the secondary winding 52 opposes the current flowing through the lamp 11 during this flyback cycle, thereby increasing the impedance to the current flowing through the lamp 11, thus reducing the efficiency of the control circuit of FIG. 4. Furthermore, the inductance of the secondary winding 52 represents a significant increase in the total inductance of the control circuit of FIG. 4, which corresponds to a significant increase in the flyback voltage impressed across the transistor 14 and the varistor 27. This increase in flyback voltage causes the varistor 27 to conduct more current to ground during the flyback cycle of the circuit of FIG. 4, representing a further loss in efficiency of this circuit of FIG. 4. Thus, it is apparent that introduction of the high voltage ignition circuit used in prior art 60-Hertz ballast circuits into the 20-KiloHertz lamp control circuit of FIG. 1, as illustrated in FIG. 4, significantly reduces the efficiency of the 20-KiloHertz lamp control circuit.

DESCRIPTION OF THE PREFERRED EMBODIMENT OF THE INVENTION

Figure 5:
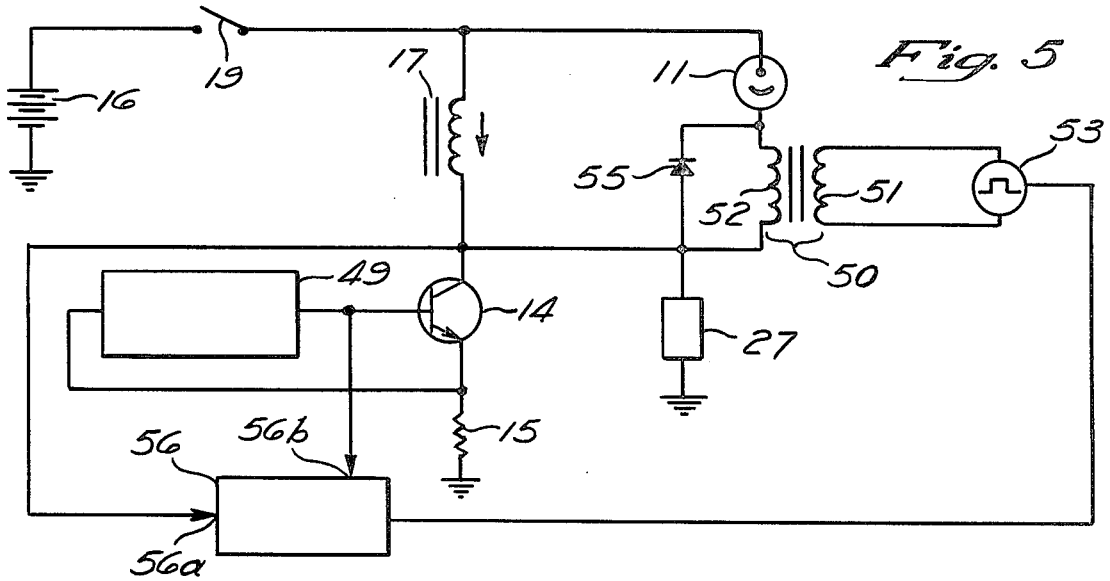
FIG. 5 is a simplified schematic diagram of one embodiment of this invention including a step-up transformer having its secondary winding connected in series with the lamp and its primary winding connected to a comparative discharge device and further including means preventing the inductance of the secondary winding from interfering with the normal operation of the lamp control circuit.

The circuit of FIG. 5 illustrates an embodiment of the invention in which the foregoing problems are solved. The control circuit of FIG. 5 includes a lamp control circuit similar to the lamp control circuit of FIG. 1, and further includes a pulse transformer 50 having its primary winding 51 connected across a pulsed voltage source 53 such as a capacitive discharge device and a secondary winding 52 connected in series with the lamp 11. In addition, the circuit includes a rectifying diode 55 connected across the secondary winding 52, and a control circuit 56.

The diode 55 may be any rectifying means, and has its polarity disposed so as to permit current flowing from the inductor 17 to the lamp 11 when the transistor 14 is turned off to flow through the diode 55 and bypass the secondary winding 52 and provides an alternate path for current flowing in the secondary winding 52 during the flyback cycle. The diode 55 maintains a substantially constant current through the secondary winding 52 so that the winding 52 does not present any substantial impedance or energy loss during the charging cycle of the circuit. This feature substantially prevents the inductance of the secondary winding 52 from affecting the operation of the lamp control circuit during its normal operating mode after the lamp 11 has been ignited.

A control circuit 56 controls the operation of the pulsed voltage source 53. The control circuit 56 has one of its inputs **56*a* sensing the collector voltage on the transistor 14, while its other input 56*b* senses the output from the control circuit 49 to the base of the transistor 14**.

Operation of the circuit of FIG. 5 is as follows. When the circuit is first activated and the lamp 11 is to be ignited, a large flyback voltage appears across the transistor 14 as discussed above in connection with FIGS. 1, 2, and 3. Input **56*a* and the control circuit 56 sense that the lamp 11 is off by sensing this large collector voltage, which means that the voltage source 53 must be activated to ignite the lamp. The control circuit 56 will activate the pulse voltage source 53 only after the transistor 14 is turned back on, in order to prevent the large ignition voltage from the pulse transformer 50 from imposing a large collector voltage on the transistor 14. When the transistor 14 is on, this is sensed at the input 56*b* of the control circuit 56 by sensing the output voltage of the control circuit 49 to the base of the transistor 14. At this time, the control circuit 56 causes the pulsed voltage source 53 to impose a voltage in the primary winding 51, which is of sufficient magnitude to cause an ignition voltage of 2500 volts on the secondary winding 52. This ignition voltage causes the gas in the lamp 11 to begin ionization. If this ionization is not complete, then during the next cycle of the lamp control circuit the control circuit 56 will again sense that the lamp is still nonconducting by a high collector voltage of the transistor 14 sensed at input 56*a*. Again, as soon as the base voltage of the transistor 14, sensed by input 56*b*, indicates that the transistor 14 is on, the control circuit 56 will reactivate the pulsed voltage source 53 causing the pulse transformer 50 to produce a 2500-volt ignition pulse for a duration determined by the pulsed voltage source 53. This cycle will repeat itself until the lamp 11 has ionized sufficiently to permit a normal driving of the lamp 11 with only the driving circuit 49**.

This circuit has the advantage that, after the lamp 11 is ignited, the inductance of the secondary winding 52 does not affect the operation of the lamp control circuit. The operation of the circuit of FIG. 5 when the lamp 11 is ignited is as follows: After ignition of the lamp 11, the control circuit of FIG. 5 assumes its normal operating mode similar to that described above in connection with FIGS. 1 and 3, and the secondary winding 52 effectively becomes an inductor, as the control circuit 56 opens the primary winding 51 to effectively take it out of the circuit. During the charging portion of the 20-KiloHertz cycle of the control circuit of FIG. 5, when the transistor 14 is on, current flows from the power supply 16 and is divided between the inductor 17 and the lamp 11. Part of the current flows through the inductor 17 and the transistor 14 to ground, while the remaining current flows through the lamp 11, the secondary winding 52, and the transistor 14 to ground. During this charging cycle, the current through the transistor 14 will increase as the magnetic fields in the inductor 17 and the secondary winding 52 increase. During the flyback portion of the 20-KiloHertz cycle of the control circuit of FIG. 5, when the transistor 14 is off, the current flowing through the inductor 17 flows through the diode 55 and the lamp 11, thereby completely bypassing the secondary winding 52. As a result, the magnetic field in the secondary winding 52 cannot oppose the current flowing through the lamp 11 during the flyback cycle. Furthermore, the diode 55 shunts the current flowing in the secondary winding 52, thereby preventing this current from affecting the operation of the control circuit of FIG. 5. As a result, the current through the secondary winding 52 does not significantly decrease during the flyback cycle. Therefore, when the transistor 14 is again turned back on, the current supplied from the power source 16 flowing through the lamp 11 is not required to significantly change the current flowing through the secondary winding 52. As a result, current in the secondary winding remains fairly constant and the secondary winding 52 does not present a significant impedance to the current flowing through the lamp 11 during the charging portion of the 20-KiloHertz cycle. Therefore, the secondary winding 52 does not absorb significant power from the power source 16.

It is now apparent that the shunting diode 55 prevents the inductance of the secondary winding 52 from affecting operation of the control circuit of FIG. 5 during either the charging portion or the flyback portion of the 20-KiloHertz cycle. Furthermore, because the diode 55 shunts the current across the secondary winding 52 during the flyback cycle, the inductance of the secondary winding 52 does not contribute to the flyback voltage across the transistor 14. Instead, only the inductor 17 contributes to the flyback voltage across the collector of the transistor 14 as does the circuit of FIG. 1 even though the circuit of FIG. 5 includes the pulse transformer 50 in series with the lamp 11 having a very high step-up ratio. This invention thus includes a source producing a high ignition voltage across the lamp 11 which does not increase the flyback voltage in the almp control circuit.

CURRENT REGULATION

Another problem inherent in the control circuit of FIG. 1 is that the power consumed by the circuit is dependent upon the effective resistance of the gas discharge lamp 11. It is well known that if the control circuit oscillates at a high frequency, the lamp 11 may be characterized as a resistor. For high pressure mercury vapor lamps, this equivalent resistance is relatively constant over the life of the lamp. The problem arises when a high pressure sodium lamp is used as the lamp 11 in the circuit of FIG. 1. The resistance of high pressure sodium lamps increases over the life of the lamp. For example, if the lamp 11 in FIG. 1 is a high pressure sodium lamp, and if the potentiometer 23 of FIG. 1 is first adjusted so that the control circuit of FIG. 1 furnishes 400 watts of power to the lamp 11, the voltage drop across the lamp when new would be approximately 95 volts. However, during the life of the lamp, this voltage can increase to 135 volts. This is because the lamp control circuit maintains a constant current through the lamp and choke parallel combination even though the lamp resistance increases. For example, as the lamp resistance increases, the control circuit of FIG. 1 will increase the lamp voltage, plotted in FIG. 2D, so that the current through resistor 15, plotted in FIG. 2C, does not change. This voltage increase corresponds to an increase in the power consumed, and a significant increase in the cost of operating the lamp control circuit.

Figure 6:
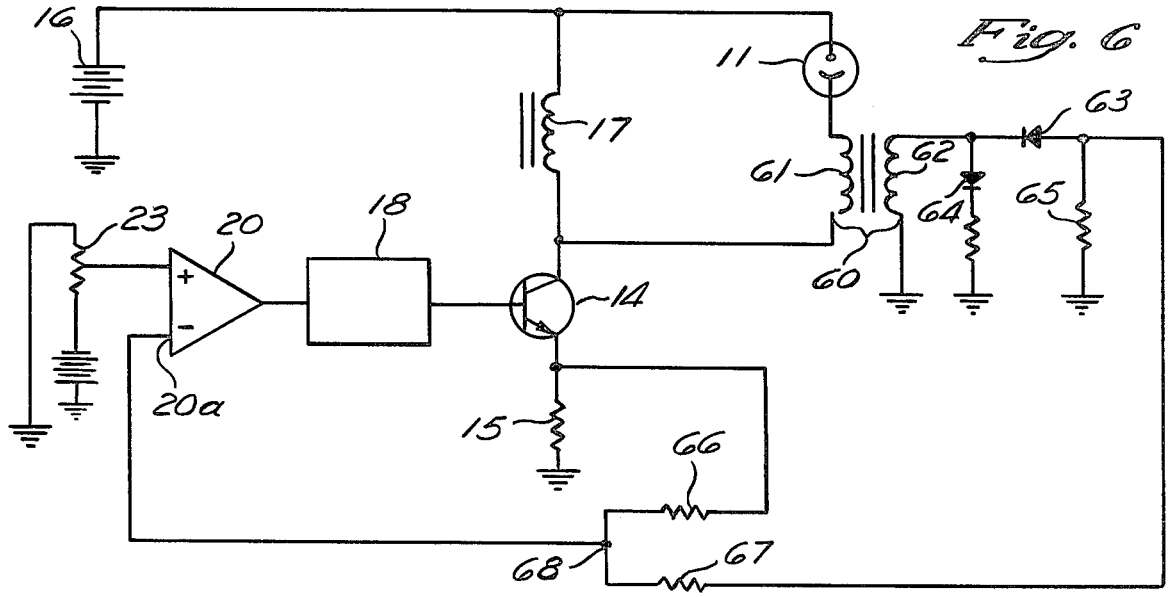
FIG. 6 is a schematic diagram of another embodiment of this invention in which a transformer having one of its windings connected in series with the lamp facilitates regulation of the current consumption of the lamp control circuit independently of the effective lamp resistance.

FIG. 6 illustrates another embodiment of the invention in which the foregoing problems are solved. The current regulation circuit of FIG. 6 comprises another transformer 60 connected in series with lamp 11 in a lamp control circuit similar to the lamp control circuit of FIG. 1. In the circuit of FIG. 6, the power consumed is independent of the equivalent resistance of the lamp 11. Therefore, if the lamp 11 in FIG. 6 is a high pressure sodium lamp, the power consumed by the lamp control circuit will remain constant, even though the equivalent resistance of the lamp 11 may increase significantly.

The transformer 60 has its primary winding 61 connected in series with the lamp. Secondary winding 62 of the transformer 60 is wound to provide a reversed polarity with respect to the primary winding 61, so that the current flowing from the voltage source 16 through the lamp 11 while the transistor 14 is on produces a negative voltage and reverse current in the secondary winding 62. Isolation diodes 63 and 64 are provided on the ungrounded side of the secondary winding 62.

The negative voltage in the secondary winding 62 causes a negative voltage to appear across the resistor 65 which is proportional only to the current through the lamp 11. Resistors 66 and 67 are connected to form a summing node 68 for the voltage across resistor 65. As discussed above in connection with FIGS. 1 and 3, the voltage across the resistor 15 is a function of the current through both the lamp 11 and the inductor 17. This voltage is applied to summing node 68 through summing node resistor 66. The negative voltage across resistor 65 is applied to summing node 68 through summing node resistor 67. The resistance values of resistors 15, 65, 66, 67 are preferably selected so that the contribution to the voltage across resistor 15 by current through the lamp 11 is precisely nulled at the summing node 68 by the negative voltage across the resistor 65.

As a result, the voltage at the summing node 68 applied to the negative input 20A of the comparator 20 is a function exclusively of the current through inductor 17, and is independent of the current through the lamp 11. As a result, the comparator amplifier 20 will control the multivibrator 18 and transistor 14 independently of changes in the equivalent resistance of the lamp 11.

Thus, the control circuit of FIG. 6 does not increase the voltage applied to the lamp 11 as the lamp resistance increases. Therefore, the power consumed by the circuit of FIG. 6 will not increase with lamp resistance as does the power consumed by the circuit of FIG. 1.

Figure 7:
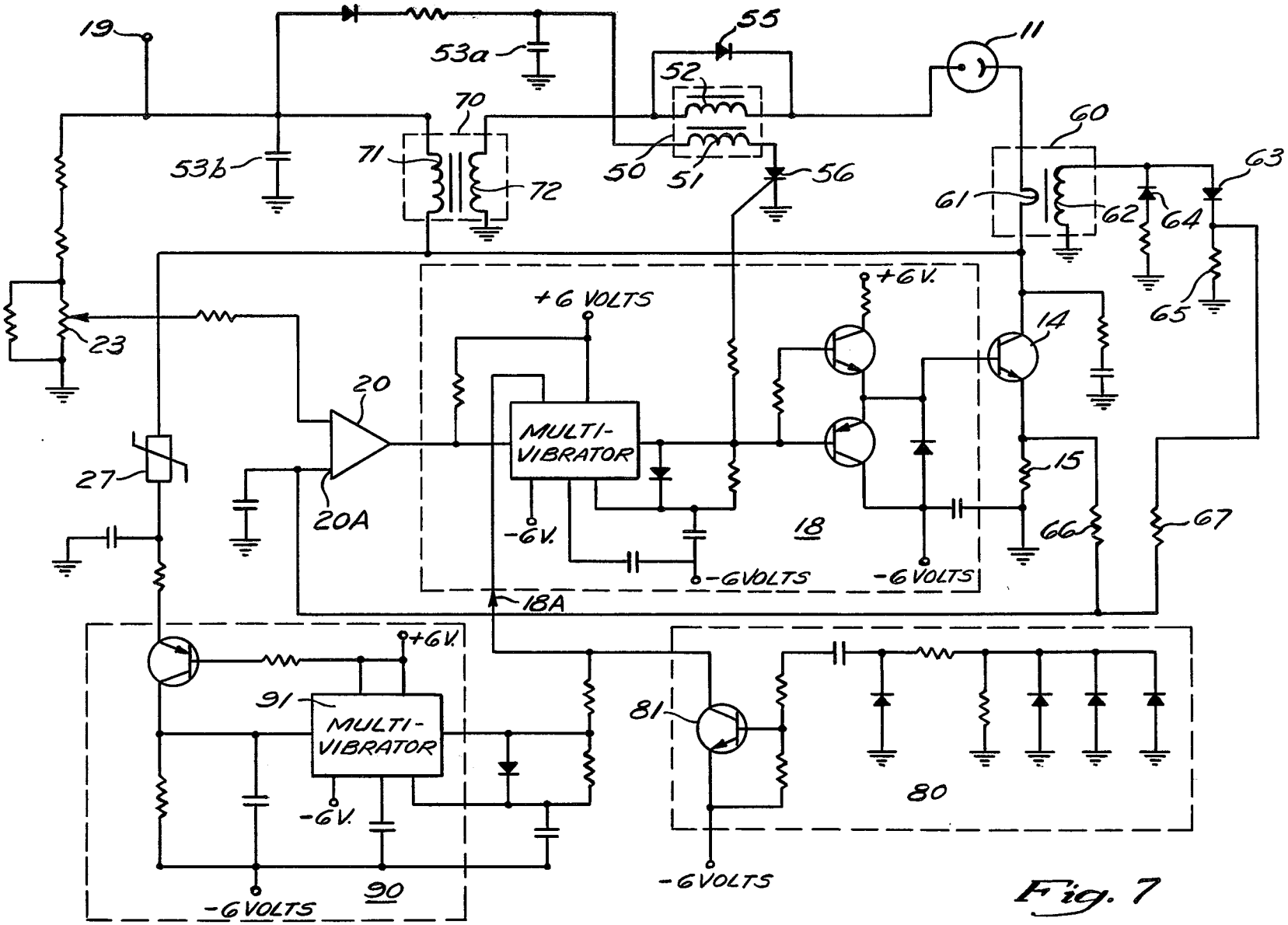
FIG. 7 is an overall detailed schematic diagram of the preferred embodiment of the control circuit of the invention including the features of FIGS. 5 and 6.

The lamp control circuit illustrated in the detailed schematic diagram of FIG. 7 includes a combination of the features discussed above in connection with FIGS. 1, 5, and 6. Thus, the circuit of FIG. 7 has a basic lamp control circuit including a gas discharge lamp 11, a switching transistor 14, a resistor 15, a multivibrator 18, and a comparator 20. However, the inductor 17 of FIG. 1 is replaced instead by a transformer 70 having primary and secondary windings 71, 72, respectively. The transformer 70 transforms the voltage from the voltage source 19 to the optimum operating voltage of the lamp 11. The basic lamp circuit including the lamp 11, the transistor 14, and the resistor 15, the multivibrator 18, the comparator 20, the potentiometer 23, and the transformer 70 operate in the manner described above in connection with the lamp control circuit of FIG. 1.

The high ignition voltage circuit of FIG. 5 is included in the circuit of FIG. 7 as the pulse transformer 50 having its primary winding 51 connected to discharge capacitors 53*a*, 53*b*, and to controller 56. The diode 55 is connected across the secondary winding 52 in the circuit of FIG. 7 and prevents the inductance of the secondary winding 52 from affecting the operation of the basic lamp control circuit, in the same manner as described above in connection with the pulse transformer circuit of FIG. 5. The controller 56 is preferably a silicon controlled rectifier. The gate of the silicon controlled rectifier is connected to the multivibrator circuit 18. When the multivibrator circuit 18 turns the transistor 14 on, it simultaneously causes a voltage at the gate of the silicon control rectifier 56 to turn the silicon control rectifier 56 on. This completes the circuit between the discharge capacitors 53*a*, 53*b*, and the primary winding 51 of the pulse transformer 50. As described above in connection with FIG. 5, this generates a 2500-volt ignition voltage across the secondary winding 52, which drives the lamp 11. After ignition of the lamp, even though the S.C.R. 56 continues to fire each time transistor 14 turns on, the 20-KHz switching frequency of transistor 14 prevents significant voltage from building up in capacitors 53*a*, 53*b* so that they no longer have any effect in the circuit.

The current regulation circuit described above in connection with FIG. 6 is also present in the circuit of FIG. 7, and includes the transformer 60 having its primary winding 61 connected in series with the lamp 11, and its secondary winding 62 wound with opposing polarity and connected through isolation diode 63 to resistor 65. Summing node 68 sums the voltage across resistor 15 through summing resistor 66 and the voltage across resistor 65 through summing resistor 67 and applies the resultant voltage to the input 20*a* of comparator 20. This current regulation circuit operates in the same manner described above in connection with the current regulation circuit of FIG. 6.

The circuit of FIG. 7 also includes a delay circuit 80 connected to shut-down input 18*a* of the multivibrator circuit 18. The delay circuit 80 shuts down the multivibrator circuit 18 by applying a signal to shut down input 18*a* as soon as power is first applied from the voltage source 19 in order to allow the discharge capacitors 53*a*, 53*b* to have enough time to charge up to a sufficient voltage to ignite lamp 11. After a predetermined length of time, the delay circuit 80 no longer shuts down the multivibrator circuit 18, and the lamp control circuit of FIG. 7 begins to operate. The metal oxide varistor 27 is connected to the collector transistor 14 in the same manner as described above in connection with FIG. 1. However, a second shut-down circuit 90 is provided which shuts down the multivibrator circuit 18 for a predetermined length of time whenever the varistor 27 senses a high enough voltage across transistor 14 to break down. The low side of varistor 27 is connected to the input of the protective shut-down circuit 90. The output of the second shut-down circuit 90 is connected to the shut-down input 18*a* of multivibrator circuit 18. The second shut-down circuit 90 includes an astabile multivibrator 91. Breakdown of the varistor 27 causes the multivibrator 91 to change state and issue a signal to the shut-down input 18, which holds the multivibrator circuit 18 shut down for a predetermined length of time determined by the duration of the astabile state of the multivibrator 91.

This arrangement permits repeated pulses to be produced for starting the lamp if ionization is not complete after the first pulse, by allowing the capacitors 53*a* and 53*b* sufficient time to recharge. Again, after the capacitors 53*a*, 53*b* have recharged, the S.C.R. 56 again fires to cause a high voltage pulse across the lamp.

What is claimed is:

1. A circuit for energizing a gas discharge lamp comprising:

switching means for generating an alternating current above 20 KHz for illuminating a lamp;

means for inducing a high voltage igniting pulse on said lamp, said means connected in series with said lamp; and means automatically preventing the impedance of said high voltage means from affecting operation of said switching means and lamp upon ignition of said lamp.

2. A control circuit for energizing a gas discharge lamp, comprising:

switching means alternately generating a charging current and a flyback current in opposite directions connected across said lamp for sustaining and controlling illumination in said lamp;

pulse transformer means connected in series with said lamp for initially igniting said lamp; and means for automatically preventing the magnetic field in said pulse transformer means from opposing current flow through said lamp.

3. A circuit as defined in claim 2 wherein:

said pulse transformer means comprises a primary winding and a secondary winding;

said primary winding is connected across a voltage source;

said secondary winding is connected in series with said lamp; and said preventing means comprises a diode means connected across said secondary winding providing an alternate path to current flowing through said secondary winding.

4. A circuit as defined in claim 2 wherein:

said switching circuit means comprises an inductor means generating a flyback voltage during every other half cycle of said switching circuit means; and said preventing means prevents inductance in said pulse transformer means from contributing to said flyback voltage.

5. A circuit as defined in claim 3 wherein said voltage source connected across said primary winding comprises a capacitive discharge device.

6. A circuit as defined in claim 3 wherein said primary and secondary windings define a turns ratio in said pulsed transformer which steps up voltage from said voltage source to a high voltage sufficient to ignite said lamp.

7. A circuit as defined in claim 4 wherein said preventing means permits current flow in one direction only, the polarity of said preventing means disposed so that both current generated in said inductor means causing said flyback voltage and current generated by inductance in said pulse transformer means during said every other half cycle flows through said rectifier means.

8. A circuit as defined in claim 5 wherein said capacitive discharge device comprises a capacitor connected across said primary winding, a silicon controlled rectifier connected in series with said capacitor, and a control circuit which triggers said silicon controlled rectifier only when said switching means is in a conducting state.

9. A circuit as defined in claim 3 wherein said diode means maintains a nearly constant current through said secondary winding.

10. A circuit for operating a gas discharge lamp comprising:

means for storing energy connected in parallel combination with said lamp;

switching means connected in series with the parallel combination of said lamp and said storing means;

means for sensing current through said switching means;

means for subtracting the current through said lamp from the current sensed in said sensing means to produce a difference signal; and control means for temporarily turning said switching device off in response to current sensed by said sensing means above a predetermined level, said control means responsive to said difference signal to operate independently of current through said lamp.

11. A circuit as defined in claim 10 wherein said subtracting means comprises a transformer having its primary winding connected in series with said lamp and a secondary winding connected across a resistor means so that current flow through said lamp induces a voltage across said resistor.

12. A circuit as defined in claim 11 wherein said current flow through said lamp causes a negative voltage to appear at one end of said resistor with respect to its other end, and said circuit further comprises means sending at least a portion of said negative voltage to said sensing means so that lamp current sensed by said sensing means is nulled.

13. A circuit as defined in claim 10 wherein said secondary winding is wound in an opposite sense with respect to said primary winding so that a negative voltage is induced in said secondary winding by current flowing through said lamp while said switching means is on.

14. A circuit as defined in claim 13 wherein said sensing means responds to a first voltage proportional to said current through said parallel combination, said circuit further comprising summing means for combining said negative voltage and said first voltage at said sensing means.

15. A circuit for energizing a high intensity, high pressure gas discharge lamp comprising:

a power source;

a lamp;

means for storing energy connected across said lamp in a parallel combination;

switching means connected in series with said parallel combination;

means for sensing the current in said parallel combination for activating said switching means; and means for preventing increased lamp resistance from causing an increase in the power consumed from said source.

16. A circuit as defined in claim 15 wherein said lamp is a high pressure sodium lamp.

17. A circuit for energizing a gas discharge lamp comprising:

a lamp;

means for storing energy connected across said lamp in a parallel combination;

switching means connected in series with said parallel combination; and means for operating said switching means independently of current through said lamp.

18. A circuit as defined in claim 18 wherein said operating means senses current through said storing means exclusively.

* * * * *